US008240458B2

(12) United States Patent
Keller

(10) Patent No.: US 8,240,458 B2
(45) Date of Patent: Aug. 14, 2012

(54) DEVICE AND METHOD FOR THE TRANSFER OF FLEXIBLE FLAT ARTICLES

(75) Inventor: Alex Keller, Rapperswil (CH)

(73) Assignee: Ferag AG, Hinwill (CH)

( * ) Notice: Subject to any disclaimer, the term of this patent is extended or adjusted under 35 U.S.C. 154(b) by 313 days.

(21) Appl. No.: 12/695,588

(22) Filed: Jan. 28, 2010

(65) Prior Publication Data

US 2010/0200368 A1 Aug. 12, 2010

(30) Foreign Application Priority Data

Feb. 6, 2009 (CH) ..... 0181/09

(51) Int. Cl.
*B65G 25/00* (2006.01)

(52) U.S. Cl. ..... 198/470.1; 198/803.3; 271/204; 271/277

(58) Field of Classification Search ..... 198/470.1, 198/471.1, 472.1, 803.1, 803.3, 803.4, 803.5, 198/803.6, 803.7, 803.8, 803.9; 271/204, 271/277

See application file for complete search history.

(56) References Cited

U.S. PATENT DOCUMENTS 5,046,711 A * 9/1991 Merwarth et al. ..... 271/11
5,110,108 A 5/1992 Muller
6,672,447 B2 1/2004 Muller
6,814,352 B2 * 11/2004 Ramseier ..... 271/69
7,591,466 B2 9/2009 Kyburz
7,784,784 B2 * 8/2010 Meyerhans et al. ..... 271/204

FOREIGN PATENT DOCUMENTS

EP 0380921 A2 8/1990
EP 1281650 A1 2/2003
EP 1834911 A1 9/2007

* cited by examiner

*Primary Examiner* — Joseph A Dillon, Jr.

(74) *Attorney, Agent, or Firm* — Rankin, Hill & Clark LLP

(57) ABSTRACT

A device and method for the transfer flexible flat articles between two conveyors. The device includes a first gripper conveyor with first grippers moved along a first gripper conveyor track for suspended transportation of the articles in a conveying direction, and a second gripper conveyor with second grippers moved along a second gripper conveyor track. Opening and closing of the grippers is controlled so that a transfer of the articles from the first to the second grippers is able to take place. In doing so, a spacing between the first grippers differs from the spacing between the second grippers such that, in a transfer zone, one gripper conveyor track, the grippers of which include the greater spacing between one another, defines a concave course, and the other gripper conveyor track, the grippers of which have the smaller spacing between one another, defines a correspondingly convex course.

14 Claims, 2 Drawing Sheets

DEVICE AND METHOD FOR THE TRANSFER OF FLEXIBLE FLAT ARTICLES

BACKGROUND OF THE INVENTION

1. Field of the Invention

The invention is situated in the field of materials handling technology and concerns a device and a method for the transfer of flexible flat articles, in particular printed products, between two conveyors, in accordance with the preamble of the corresponding independent claims.

2. Description of Related Art

The patent document EP-A 1834911 describes a transfer device, in the case of which individual articles are transferred by first grippers to moving in parallel second grippers. The second grippers are arranged below the first grippers. In a transfer zone the first grippers are opened, so that the articles due to the force of gravity slide into the moving along open second grippers, which thereupon are closed. For the stabilisation of the articles during the transfer, resp., in the transfer zone, a stabilisation device is provided, which comprises two helix- or spiral-shaped rotors oriented in opposite directions. These, respectively, laterally dip into the gaps between the articles held by the first grippers and thus form an essentially vertically oriented plane support, which moves along with the articles through the whole transfer zone, keeps these straight and only finishes, when the second gripper is closed. A disadvantage of this arrangement is the relatively large volume, which is required by the lateral rotors, as well as the complexity of the complete stabilisation device.

EP 1 281 650 A1 describes a device for bringing together articles individually held in a gripper conveyor, which are always taken over in twos by the grippers of a gripper wheel, and in this manner are transferred to a taking-away conveyor. In doing so, the gripper conveyor, viewed in a circumferential direction of the gripper wheel, extends around the gripper wheel along a certain angle with a concave course, in order to transfer the articles to the gripper wheel. Because of the utilisation of the gripper wheel for the transfer between the gripper conveyor and the taking-away conveyor, the device is comparatively complex.

EP 0 380 921 A1 manifests a device for the taking over and passing on of printed sheets. The printed sheets are supplied suspended by a first conveyor system and transferred to a second conveyor system. In doing so, a transfer system with rotating receiving compartments is provided. In the zone of the transfer system, the first conveyor system comprises a concave track course around the transfer system. Because of the utilisation of the transfer system, the device is comparatively complex.

BRIEF SUMMARY OF THE INVENTION

The invention therefore is based on the object of indicating a device and a method for the transfer of, in preference, flexible, plane articles from a first gripper conveyor to a second gripper conveyor, in the case of which the described disadvantages are avoided.

This object is achieved by a device and by a method with the features of the corresponding independent claims.

The corresponding device comprises a first gripper conveyor with first grippers moved along a first gripper conveyor track for the essentially suspended transportation of the articles in a direction of conveyance. Hereby first article edges are gripped by the first grippers. The articles are conveyed individually or in groups; in the case of conveyance in groups, it is possible that the first article edges lie upon one another or else are displaced relative to one another within the gripper. Apart from this, a second gripper conveyor with second grippers moved along a second gripper conveyor track is present. These take over articles, in that they grip a second article edge, which is located opposite the first gripper edge. The conveyor tracks are constructed and equipped in such a manner that within a transfer zone a transfer of the articles from the first grippers to the second grippers is able to take place. A spacing between the first grippers along the first conveyor track differs from the spacing between the second grippers along the second gripper conveyor track. In the transfer zone:

- that gripper conveyor track, the grippers of which comprise the greater spacing between one another on the means of conveyance, comprises a concave course; and
- that gripper conveyor track, the grippers of which comprise the smaller spacing between one another on the means of conveyance, comprises a correspondingly convex course.

As a result it becomes possible, to maintain within the transfer zone a constant distance between the respectively first and second grippers, between which one of the articles is transferred, although the first and the second grippers on the means of conveyance move with differing spacing and with differing speeds. This therefore signifies, that the grippers and in particular also the points, at which the grippers hold the flat objects, travel in such a manner, that the distance between corresponding grippers of the two conveyor tracks remains constant in the transfer zone.

The two gripper conveyors in preference are chain conveyors; this signifies, that a plurality of grippers together forms a chain of grippers, therefore a gripper chain, respectively that the grippers are arranged on a conveyor chain. The chain together with the grippers is movable along a conveyor track, wherein it is possible that the conveyor track comprises essentially any course in either two—or in three dimensions. This is in contrast to an arrangement of grippers, which are, for example, arranged on a drum, in particular rigidly and in the case of which the grippers follow a circular track. In other words: Outside the transfer zone both the first as well as the second gripper conveyor (respectively the corresponding gripper conveyor track) have a different curvature than within the transfer zone.

The spacing of the grippers on the conveying means in the following is designated as conveying means spacing. This, therefore, is the distance between the points, at which the grippers are attached to the conveying means. The distance between the points, at which the grippers hold the articles (in the following designated as holding distance), in the case of a straight line course of the conveying means is identical to the conveying means spacing (distance). In case of a concave course of the conveying means, the holding distance is smaller than the conveying means spacing, in case of a convex course, the holding distance is greater.

By means of this synchronised movement of the grippers the upper and the lower edge of the article during the whole time period, in which the grippers are within the transfer zone, are able to be in the same position relative to one another and to the assigned upper and lower gripper. As a result of this, in comparison longer and stable transfer phase the quality and the security of the transfer are improved.

In addition, the articles are capable of being transferred within the transfer zone without being bent or compressed. As a result once again, it is possible to make do without additional elements for the stabilisation or guidance of the article within the transfer zone. The articles within the transfer zone—up until their release by the upper gripper—essentially are being conveyed in a suspended manner. The movement of the articles within the transfer zone therefore is mainly determined by the movement of the grippers in association with the force of gravity and the inertia and flexibility of the articles.

In the following, one departs from the transfer from an upper to a lower gripper conveyor, because this is particularly advantageous for flexible products being conveyed in a suspended position. Fundamentally, however, the transfer in an analogue manner is also capable of being from a lower to an upper gripper conveyor. For this purpose, either the articles have to be rigid, or else they have to be held upright with additional means. These additional means, for example, are lengthened holding elements on the lower grippers, or additional auxiliary conveyors, the movement track of which within the transfer zone runs parallel to the track of the first, resp., second grippers.

Understood as a transfer zone is that zone, in which the transfer process of the articles from the first grippers to the second grippers is able to take place, in particular because the grippers have approached one another to such an extent, that a controlled transfer is possible. In the transfer zone, the article in preference is capable of being influenced both by the first grippers as well as by the second grippers. A controlled transfer, in the case of which the articles are gripped at every point in time, takes place, for example, in that the second grippers or auxiliary grippers moved along with them are closed and the first grippers subsequently are opened.

The terms "concave" and "convex" here are understood as outwards from the corresponding conveyor track, therefore from the conveyor track in the direction of the grippers and of the conveyed products. If the gripper conveyor track is bent in such a manner, that the grippers are inclined towards one another, it is designated as concave. If the grippers are fanned open to some extent, then this is designated as a convex course.

In preference, the two gripper conveyor tracks along the transfer zone respectively comprise the shape of an arc of a circle, and the two circular arcs are concentric to one another. In doing so, in preference, the radii of the two circular arcs in the transfer zone are in the same numerical ratio to one another as the distances between the grippers of the two conveyor tracks. If therefore, for example, in the transfer zone

- the spacing of the grippers in the gripper conveyor track with the greater conveyed means spacing is a,
- the radius of this concave gripper conveyor track is ra,
- the spacing of the grippers in the other gripper conveyor track (the one with the smaller conveyed means spacing) is b, and
- the radius of this convex gripper conveyor track is rb, then at least approximately in preference a:b=ra:rb is applicable. In doing so, the grippers, respectively, the clamps of the grippers of the two gripper chains in the transfer zone are mutually aligned with one another. This signifies that a gripper of the first gripper chain with its opening points in the direction of the corresponding, respectively, opposite gripper of the second gripper chain and vice versa.

This is applicable in analogy for the speeds, with which the first and second grippers are conveyed within the transfer zone. If therefore in the transfer zone the speed in the concave gripper conveyor track amounts to va, and if the speed in the convex gripper conveyor track amounts to vb, then in preference, at least approximately, a:b=va:vb is applicable.

As the spacing of the grippers in the above conditions it is possible, for example, to consider the spacing of the points, at which the articles are gripped, therefore the holding distance, or e.g. the spacing of the suspension of the grippers on the corresponding gripper conveyor, therefore the spacing of the conveying means. When the grippers in the transfer zone essentially stand off vertically from the direction of movement of the gripper conveyors, then the above relationships between radii, speed and distances are applicable in both cases.

With respect to the process, the following steps are carried out: Conveyance of the articles with the first gripper conveyor essentially suspended in the conveying direction, wherein the first grippers hold the articles at a first article edge; onward conveyance of the articles by the second gripper conveyor, wherein the second grippers hold a second article edge, which is located opposite the first article edge; transfer of the articles from the first grippers to the second grippers in the transfer zone by opening the first grippers and closing the second grippers; wherein a spacing between the first grippers along the first gripper conveyor track differs from the spacing between the second grippers along the second gripper conveyor track. In doing so,

- the grippers of that gripper conveyor track, which are conveyed with a greater spacing between one another, are conveyed along a track with a concave course; and
- the grippers of that gripper conveyor track, which are conveyed with a smaller spacing between one another, are conveyed along a track with a convex course.

Further preferred embodiments follow from the dependent claims. In doing so, characteristics of the method claims are in analogy capable of being combined with the device claims and vice versa.

BRIEF DESCRIPTION OF THE DRAWINGS

In the following, the object of the invention is explained in more detail on the basis of preferred examples of embodiments, which are illustrated in the attached drawings. These respectively schematically depict.

Figure 1:
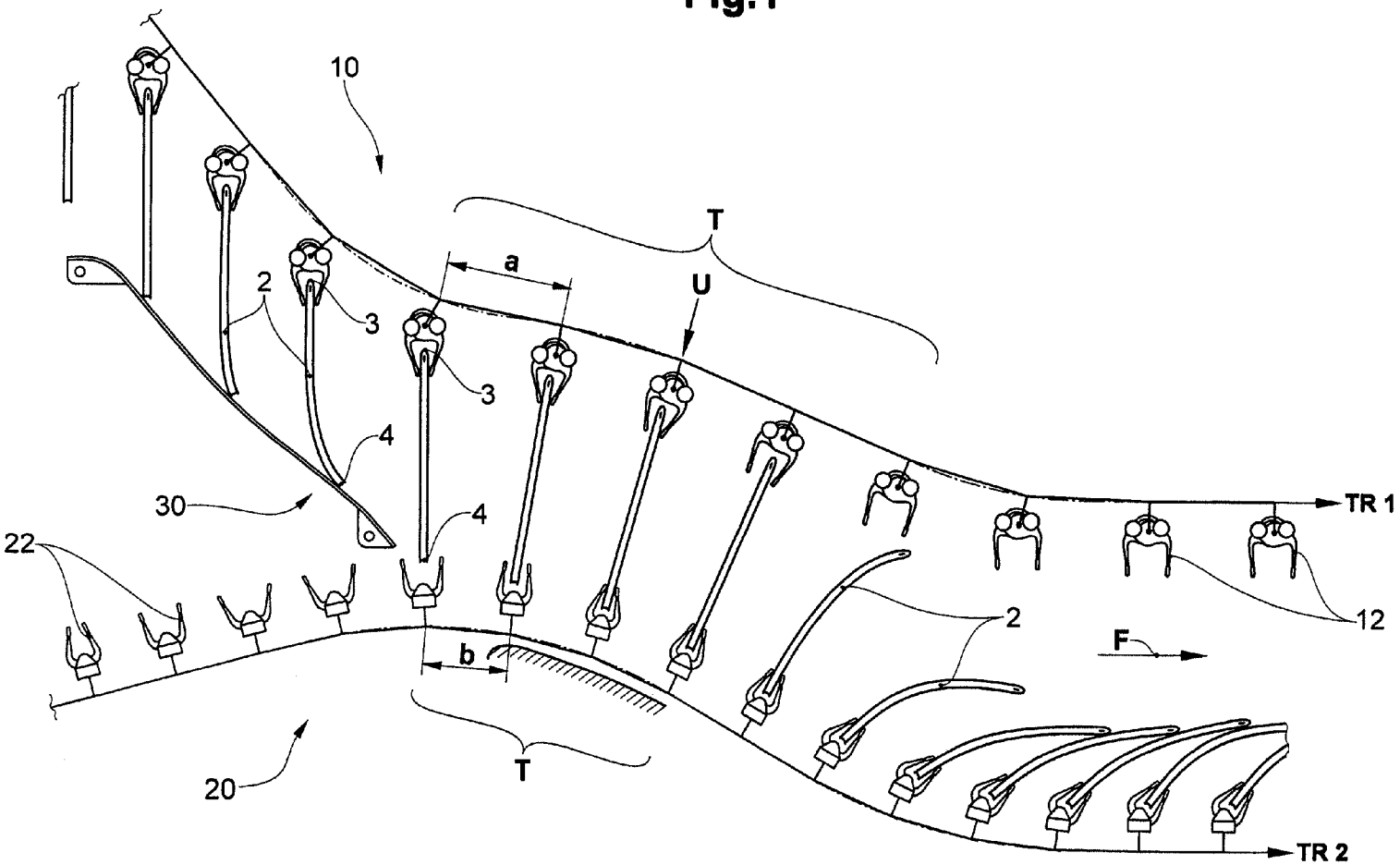
FIG. 1 a first device in accordance with the invention.

The reference marks utilised in the drawings and their significance are listed in summary in the list of reference marks. On principle in the Figures the same components are designated with the same reference marks.

DETAILED DESCRIPTION OF THE INVENTION

Figure 2:
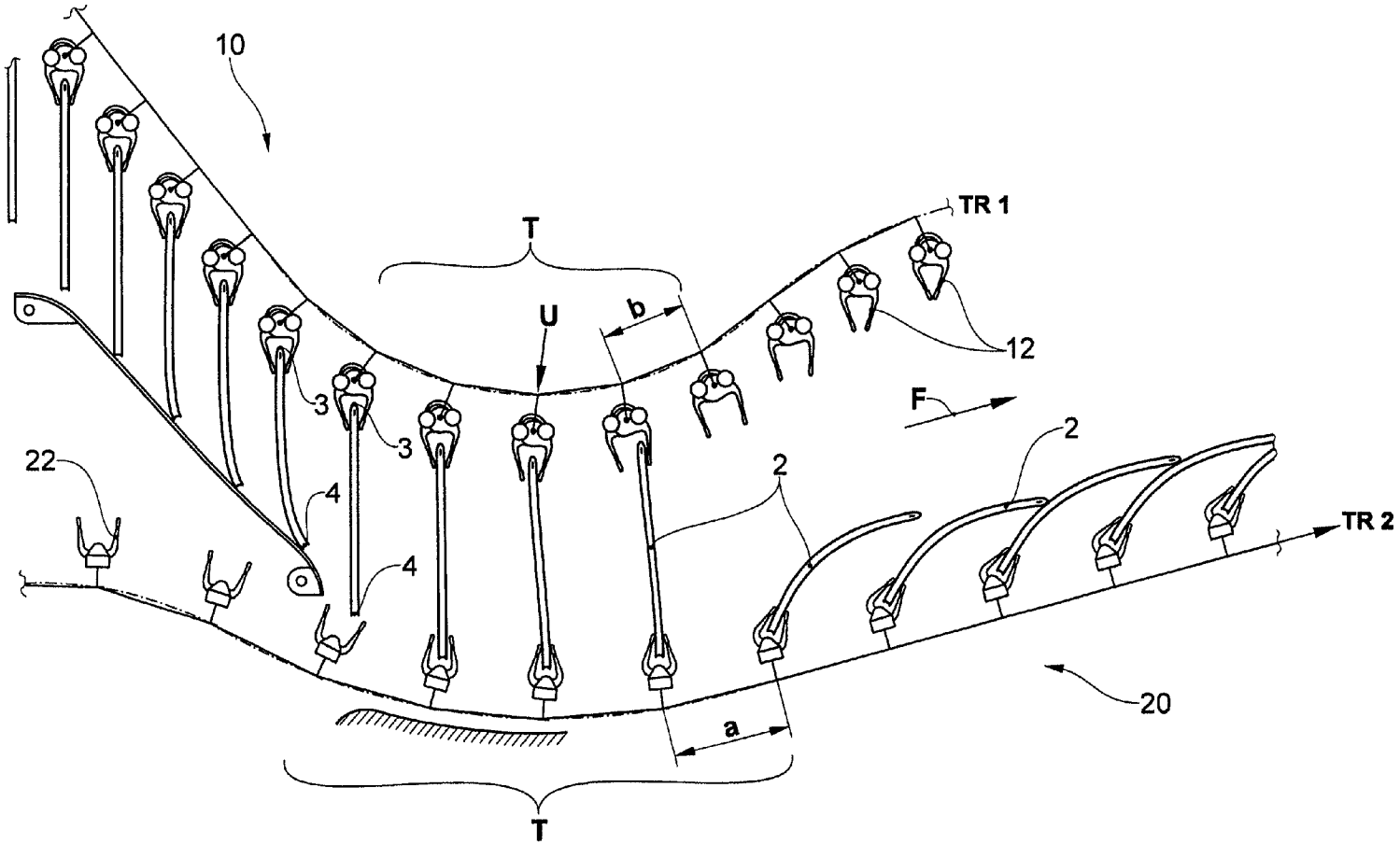
FIG. 2 a second device in accordance with the invention.

FIGS. 1 and 2 each schematically illustrate a device in accordance with the invention. In both cases there are:

- a first or upper gripper conveyor 10 with first grippers 12 moved along a first gripper conveyor track TR1 with regular spacing for the essentially suspended transportation of flat articles 2 in a conveying direction F by gripping a first article edge 3, and
- a second or lower gripper conveyor 20 with second grippers 22 moved along a second gripper conveyor track TR2 with regular spacing for taking over the articles 2 by gripping a second article edge 4, which is located opposite the first article edge 3.

Present apart from this is at least one actuation device of an as such known type, not depicted, for opening and closing the grippers 12, 22, e.g., in the form of motion control links or of other elements, which trigger the opening, resp., closing process. In preference, its own actuation device is assigned to each conveyor 10, 20.

In the transfer zone T that gripper conveyor track TR1, TR2, the grippers of which 12; 22 comprise the greater chain spacing or conveying means spacing a between one another, comprises a concave course. The chain spacing or conveying means spacing is equal to the spacing of the grippers along a chain conveyor. The term "greater conveying means spacing" is to be understood in comparison with the conveying means spacing of the grippers in the other gripper conveyor track. In FIG. 1 the gripper conveyor track with the greater conveying means spacing is the upper gripper conveyor track TR1, with a conveying means spacing a between the first grippers 12. In FIG. 2 this is the lower gripper conveyor track TR2, with a conveying means spacing a between the second grippers 22.

In the transfer zone T the gripper conveyor track TR2; TR1, the grippers of which 22; 12 have the smaller conveying means spacing b between one another, comprises a corresponding convex course to that of the opposite gripper conveyor track TR1; TR2. In FIG. 1 the gripper conveyor track with the smaller spacing between the conveying means is the lower gripper conveyor tracks TR2, with a conveying means spacing b between the second grippers 22. In FIG. 2 this is the upper gripper conveyor track TR1, with a conveying means spacing b between the first grippers 12.

In preference, in the transfer zone there are no additional guiding—or stabilisation means for the conveyed articles 2. The articles 2 as a result in the transfer zone T are essentially freely suspended between the first and the second grippers 12, 22. "Freely suspended" therefore signifies, that the articles 2 are only gripped by one—or for a brief moment—by both of the upper and lower grippers 12, 22. In the FIGS. 1 and 2 indicated respectively by an arrow is a take-over point U in the transfer zone T, at which the articles 2 are gripped by the respectively lower gripper 22, and the corresponding upper gripper 12 has opened and released the article 2.

In a preferred embodiment of the invention the device comprises a stabilisation device 30 for the stabilisation of the articles 2 held by the first grippers at least before the second article edges 4 are run into the second grippers 22. With this device the second article edges 4 at the entrance of the transfer zone T are brought into a defined position in the direction of conveyance F and in a vertical direction. The stabilisation device 30, for example, is a sheet metal guide plate, which is arranged for guiding the second article edges 4 of the conveyed articles into the opened second gripper 22.

In the examples respectively individual flat articles are mentioned and indicated. It is understood, however, that with the device in the same manner it is also possible to grip and to transfer several articles or a bundle of flat articles together.

The invention claimed is:

1. A device for transferring flexible flat articles, in particular printed products, between two conveyors, comprising:

a first gripper conveyor with first grippers moved along a first gripper conveyor track by a first gripper chain for essentially suspended transportation of the articles in a direction of conveyance by gripping a first article edge, a second gripper conveyor with second grippers moved along a second gripper conveyor track by a second gripper chain for receiving the articles by gripping a second article edge, which is located opposite the first article edge, wherein the device is designed for controlled opening and closing of the first and second grippers such that, in a transfer zone, transfer of the articles from the first grippers to the second grippers is able to take place, and wherein a substantially constant conveying means spacing between the first grippers along the first gripper conveyor track differs from a substantially constant conveying means spacing between the second grippers along the second gripper conveyor track, wherein in the transfer zone:

a gripper conveyor track, the grippers of which comprise the greater conveying means spacing (a) between one another, comprises a concave course; and another gripper conveyor track, the grippers of which comprise the smaller conveying means spacing (b) between one another, comprises a corresponding convex course.

2. The device in accordance with claim 1, wherein the two gripper conveyor tracks run such that, in the transfer zone, a distance between those first and second grippers, between which one of the articles is to be transferred, remains at least approximately constant.

3. The device in accordance with claim 1, wherein the two gripper conveyor tracks along the transfer zone are each shaped like an arc of a circle, and the two circular arcs are concentric.

4. The device in accordance with claim 3, wherein the radii of the two circular arcs in the transfer zone define at least approximately the same ratio relative to one another as the conveying means spacings (a, b) between the grippers of the two conveyor tracks.

5. The device in accordance with claim 1, wherein the flat articles in the transfer zone are essentially freely suspended between the first and the second grippers.

6. The device in accordance with claim 1, further comprising a stabilisation device for the stabilisation of the articles held by the first grippers at least before a running-in of the second article edges into the second grippers.

7. The device in accordance with claim 6, wherein the stabilisation device is a sheet metal guide plate, which is arranged in order to guide the second article edges into the opened second grippers.

8. The device in accordance with claim 1, wherein each of the first and second gripper conveyor tracks comprise a different curvature outside the transfer zone as compared to within the transfer zone.

9. A method for transferring flexible flat articles, in particular printed products, between two conveyors, comprising the steps of:

Providing a first gripper conveyor and a second gripper conveyor, conveying the articles with the first gripper conveyor, which comprises a first gripper chain with first grippers, along a first gripper conveyor track essentially suspended in a conveying direction, wherein the first grippers hold the articles at a first article edge, onward conveying of the articles by the second gripper conveyor, which along a second gripper conveying track comprises second grippers moved by means of a second gripper chain, wherein the second grippers hold a second article edge, which is located opposite the first article edge, transferring of the articles from the first grippers to the second grippers in a transfer zone by opening the first grippers and closing the second grippers, wherein a conveying means spacing between the first grippers along the first gripper conveyor track differs from the conveying means spacing between the second grippers along the second gripper conveyor track, wherein:

the grippers of that gripper conveyor track, which are conveyed with a greater conveying means spacing (a) between one another, are conveyed along a track with a concave course; and the grippers of that gripper conveyor track, which are conveyed with a smaller conveying means spacing (b) between one another, are conveyed along a track with a convex course.

10. The method in accordance with claim 9, wherein the first and the second grippers, which respectively are involved in the transfer of the same flat article, within the transfer zone are moved with a constant distance between one another.

11. The method in accordance with claim 9, wherein the first and the second grippers are each conveyed along the arc of a circle, and the two circular arcs corresponding to the movement of the first and the second grippers are located concentric.

12. The method in accordance with claim 11, wherein radii of the two circular arcs in the transfer zone are in an at least approximately equal numerical ratio to one another as speeds with which the first and the second grippers are conveyed within the transfer zone.

13. The method in accordance with claim 9, wherein the flat articles within the transfer zone are conveyed suspended essentially freely between the first and the second grippers.

14. The method in accordance with claim 9, further comprising the step of stabilizing the articles before the transfer zone, and brining the second article edges at an entrance of the transfer zone into a defined position in the conveying direction and in vertical direction.

* * * * *